US010822928B2

(12) United States Patent
Yee

(10) Patent No.: US 10,822,928 B2
(45) Date of Patent: Nov. 3, 2020

(54) RUNNING TOOL FOR AN EXPANDABLE TUBULAR

(71) Applicant: Chee Kong Yee, Katy, TX (US)

(72) Inventor: Chee Kong Yee, Katy, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 64 days.

(21) Appl. No.: 16/210,198

(22) Filed: Dec. 5, 2018

(65) Prior Publication Data

US 2020/0182023 A1 Jun. 11, 2020

(51) Int. Cl.

| | |
|---|---|
| ***E21B 43/10*** | (2006.01) |
| ***E21B 33/1295*** | (2006.01) |
| ***E21B 23/04*** | (2006.01) |
| ***E21B 23/01*** | (2006.01) |

(52) U.S. Cl.

CPC ..... *E21B 43/103* (2013.01); *E21B 23/01* (2013.01); *E21B 23/04* (2013.01); *E21B 33/1295* (2013.01)

(58) Field of Classification Search

CPC ..... E21B 43/103; E21B 23/01; E21B 23/04; E21B 33/1295

See application file for complete search history.

(56) References Cited

U.S. PATENT DOCUMENTS

| | | | | |
|---|---|---|---|---|
| 8,132,619 | B2 | 3/2012 | Smith, Jr. et al. | |
| 8,627,884 | B2 | 1/2014 | Watson | |
| 9,206,674 | B2 | 12/2015 | Luke | |
| 2014/0054047 | A1* | 2/2014 | Zhou | E21B 43/106 166/382 |

* cited by examiner

*Primary Examiner* — Brad Harcourt
(74) *Attorney, Agent, or Firm* — Cantor Colburn LLP

(57) ABSTRACT

A system for subterranean deployment in a wellbore includes an expandable tubular having an outer surface supporting at least one anchor slip and an inner surface including a running tool engagement element, and a running tool for deploying the expandable tubular into the wellbore. The running tool includes an inner surface portion defining a passage and an outer surface portion supporting a forcing cone for expanding at least a portion of the expandable tubular, and a tubular support system selectively engaging with the running tool engagement element.

19 Claims, 8 Drawing Sheets

RUNNING TOOL FOR AN EXPANDABLE TUBULAR

BACKGROUND

In the resource exploration and recovery industry, liners may be employed when a wellbore is expanded beyond an existing casing. A running tool supports the liner when being tripped into the wellbore. Once the liner is in place, an expansion cone may be activated to expand a region of the liner into mechanical engagement with the casing. Once the liner is in place, the running tool may be released and withdrawn from the wellbore. At this point, the liner may be cemented in place. Multiple cementing operations interspersed with hanging liners takes time requires multiple trips into the wellbore. Accordingly, the art would appreciate a liner hanger that could be deployed to a wellbore that has already been cemented.

SUMMARY

Disclosed is a system for subterranean deployment in a wellbore including an expandable tubular having an outer surface supporting at least one anchor slip and an inner surface including a running tool engagement element, and a running tool for deploying the expandable tubular into the wellbore. The running tool includes an inner surface portion defining a passage and an outer surface portion supporting a forcing cone for expanding at least a portion of the expandable tubular and a tubular support system selectively engaging with the running tool engagement element.

Also disclosed is a method of setting a expandable tubular including connecting a running tool engagement element arranged on an expandable tubular and a tubular support system provide on a running tool, running the expandable tubular into a wellbore, expanding the expandable tubular radially outwardly by driving a forcing cone along the running tool, engaging an anchor slip supported on an outer surface of the expandable tubular with a casing tubular, and disengaging the tubular support system from the running tool engagement element.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
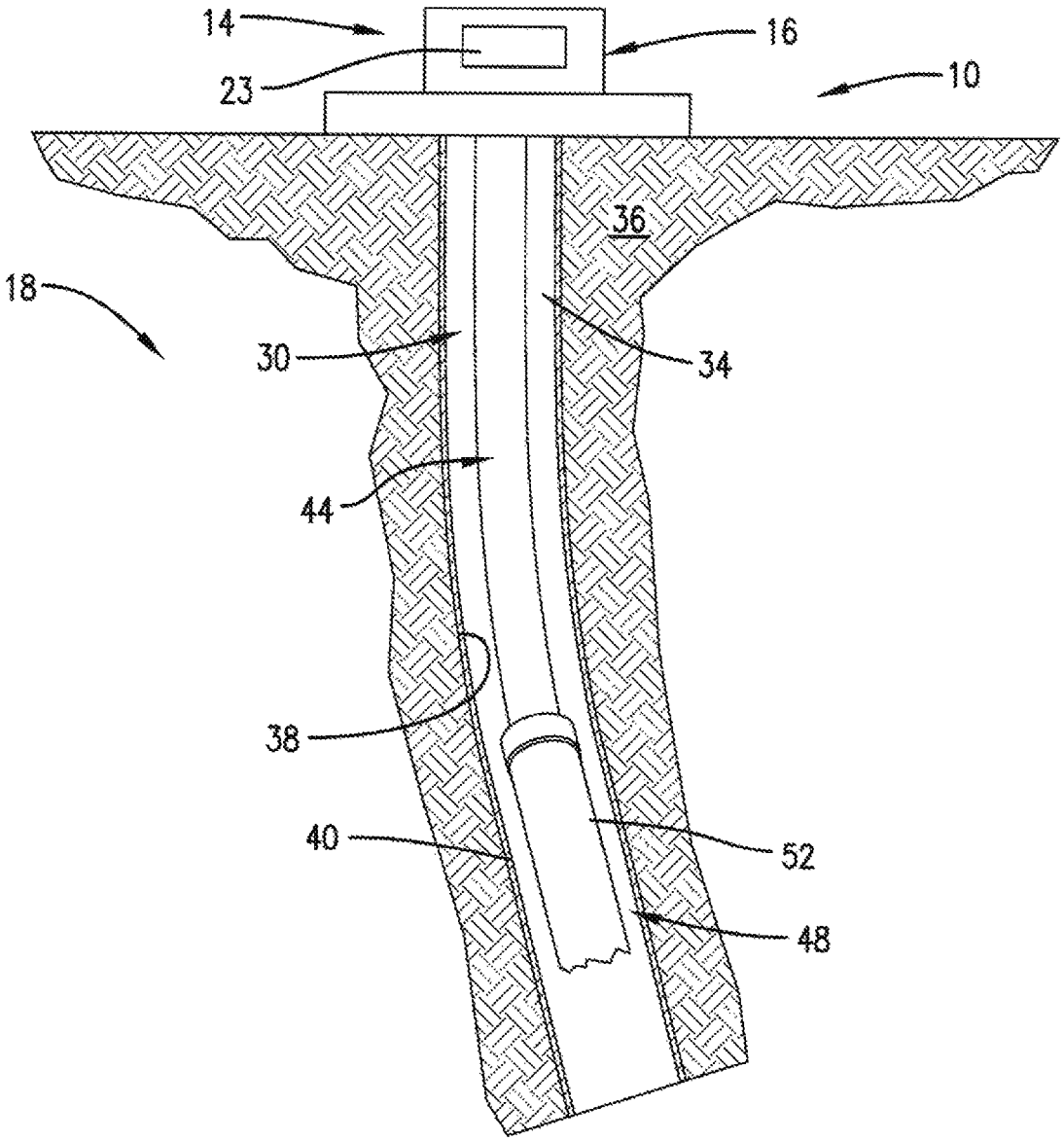
FIG. 1 depicts a resource exploration and recovery system including a running tool supporting a liner hanger, in accordance with an exemplary embodiment.

A resource exploration and recovery system, in accordance with an exemplary embodiment, is indicated generally at 10, in FIG. 1. Resource exploration and recovery system 10 should be understood to include well drilling operations, completions, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system.

First system 14 may include a control system 23 that may provide power to, monitor, communicate with, and/or activate one or more downhole operations as will be discussed herein. Surface system 16 may include additional systems such as pumps, fluid storage systems, cranes and the like (not shown). Second system 18 may include a tubular string 30 that extends into a wellbore 34 formed in formation 36. Wellbore 34 includes an annular wall 38 which may be defined by a surface of formation 36, or, in the embodiment shown, by a casing tubular 40.

Figure 2:
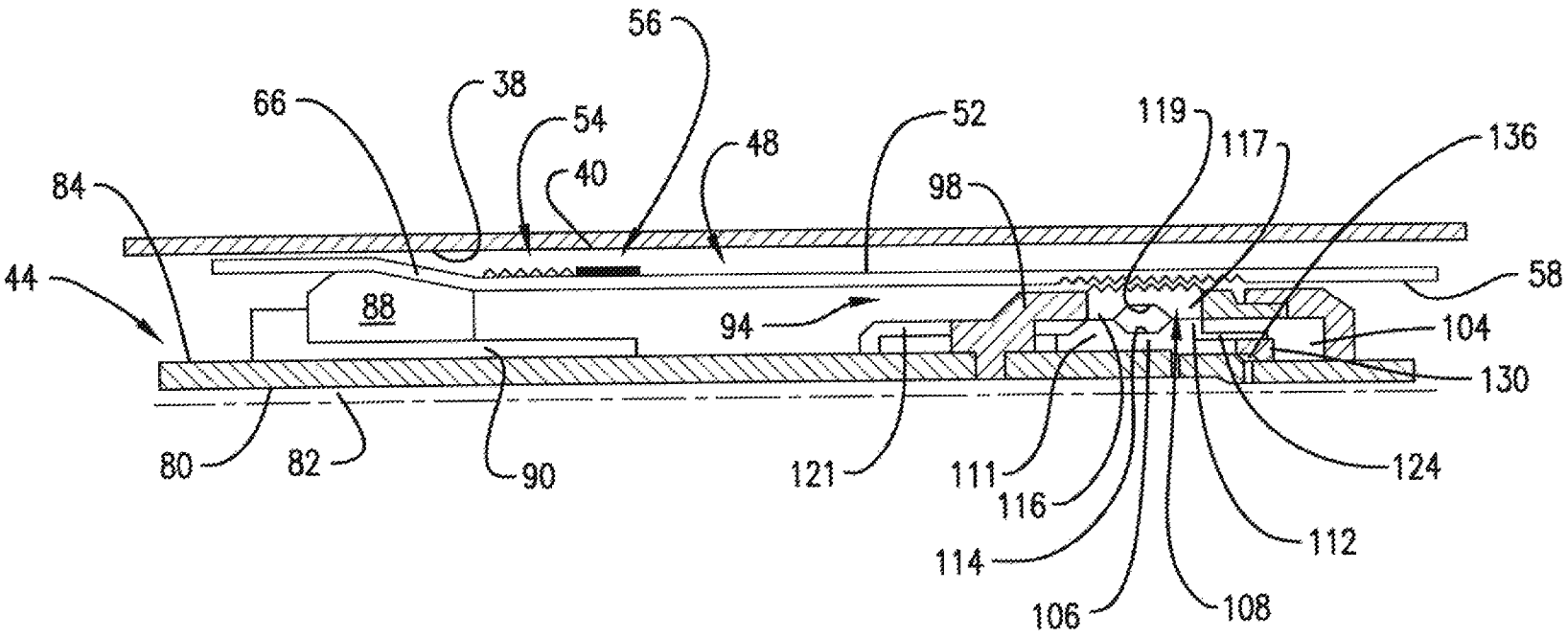
FIG. 2 depicts the running tool tripping the liner hanger into a wellbore, in accordance with an aspect of an exemplary embodiment.
Figure 3:
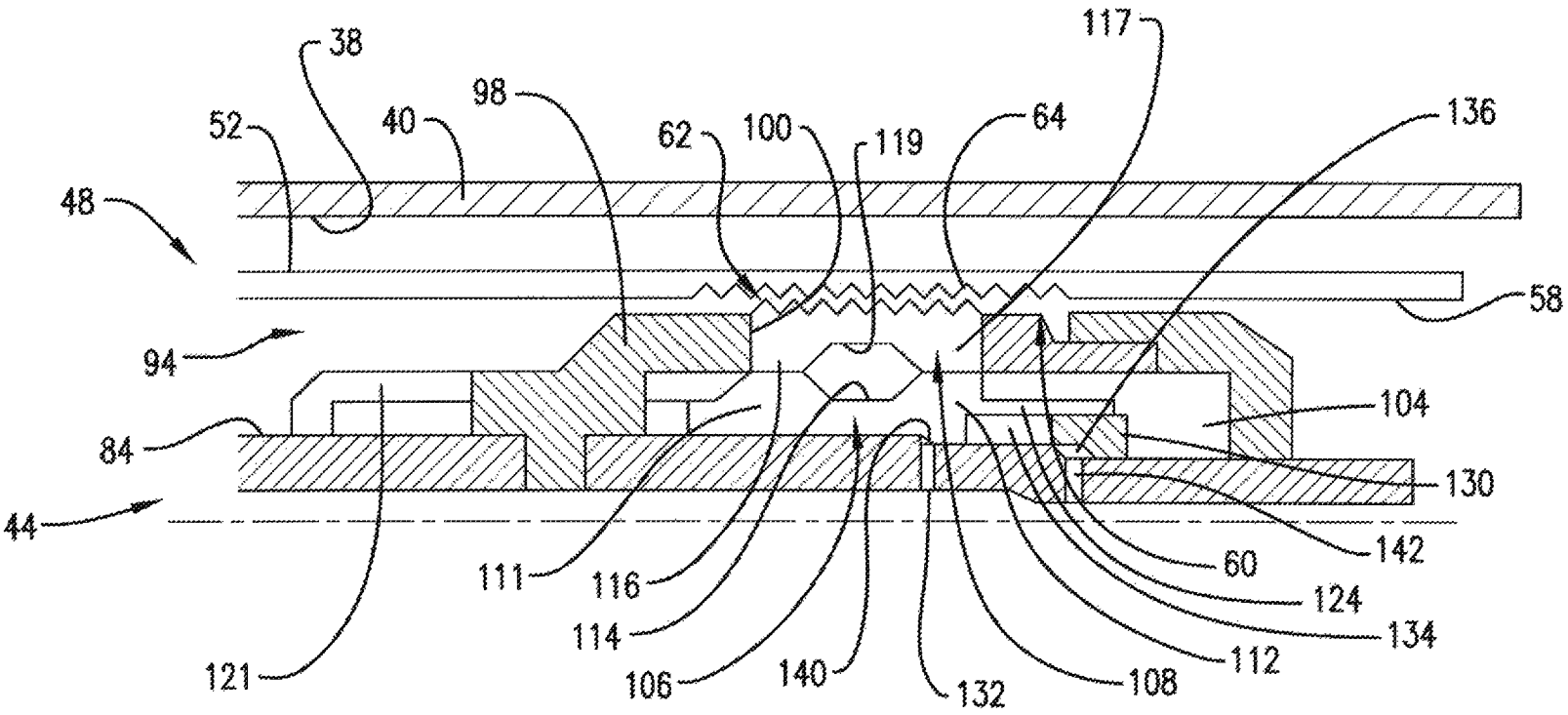
FIG. 3 depicts a detailed view of the running tool supporting the liner hanger of FIG. 2.
Figure 4:
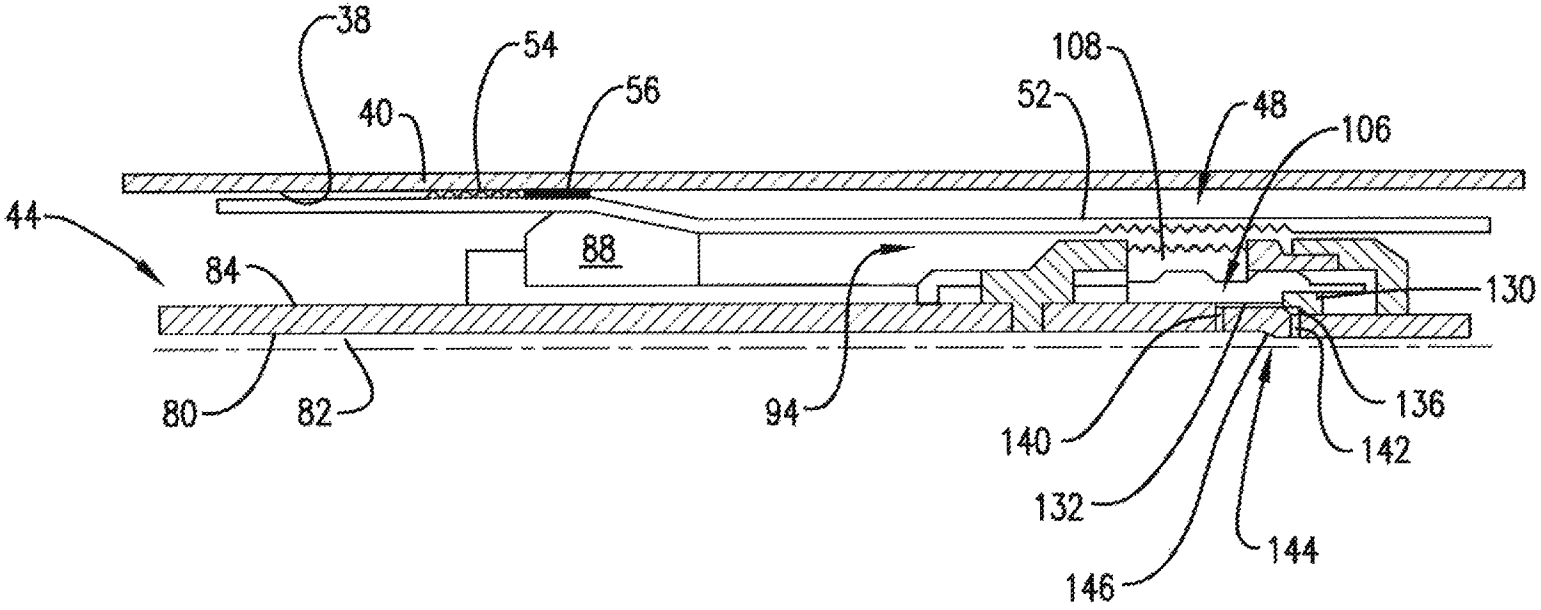
FIG. 4 depicts the running tool deploying the liner hanger of FIG. 2, in accordance with an aspect of an exemplary embodiment.

In an embodiment, tubular string 30 takes the form of a running tool 44 coupled to an expandable tubular shown in the form of a liner hanger 48. Referring to FIGS. 2-4 and with continued reference to FIG. 1, liner hanger 44 includes an outer surface 52 that supports an anchor slip 54 and a packer seal 56 that may be urged radially outwardly into contact with annular wall 38. Liner hanger 48 also includes an inner surface 58 having a running tool engagement element 60 (FIG. 3) defined by a plurality of teeth 62. Plurality of teeth 62 may be defined by a plurality of threads 64. Liner hanger 48 is also shown to include an angled region 66 (FIG. 2) arranged uphole of anchor slips 54 and packer seal 56 when in a non-deployed configuration.

In an embodiment, running tool 44 includes an inner surface portion 80 that defines a passage 82 and an outer surface portion 84 (FIG. 2). Running tool 44 includes a forcing cone 88 slideably mounted to outer surface portion 84 through a cone carrier 90. Outer surface portion 84 of running tool 44 also supports a liner hanger support system 94. Liner hanger support system 94 that selectively engages with liner hanger 48 before running tool 44 is tripped into wellbore 34.

In an embodiment, liner hanger support system 94 includes a dog body 98 fixedly mounted to outer surface portion 84 (FIG. 3). Dog body 98 includes an opening 100 that defines an interior chamber 104 which houses a dog support 106 that is axially shiftable relative to outer surface portion 84. Dog support 106 provides a platform for a dog 108 that is selectively radially shiftable relative to outer surface portion 84. Dog 108 may be guided between a deployed configuration (FIG. 2) and a non-deployed configuration (FIG. 4) by dog body 98. That is, dog 108 may extend through opening 100 into engagement with running tool engagement element 60.

In further accordance with an exemplary embodiment, dog support 106 includes a first raised portion 111 and a second raised portion 112 that flank a recess 114. Dog 108 includes a first support 116 and a second support 117 that flank a recess portion 119. First raised portion 111 is sized and shaped to be received by recess portion 119 thereby allowing dog 108 to shift radially inwardly relative to outer surface portion 84. In this manner, dog 108 may disengage from running tool engagement elements 60 allowing running tool 44 to be withdrawn from liner hanger 48 as will be detailed herein.

In further accordance with an exemplary aspect, liner hanger support system 94 includes an actuator or pusher 121 that is slideably mounted relative to outer surface portion 84 and configured to abut dog support 106. Dog support 106 also includes a projection 124 that rests upon a support element 130 mounted to outer surface portion 84.

In an embodiment, liner hanger support system 94 includes a first volume 132 defined radially inwardly of dog support 106, a second volume 134 defined radially inwardly of projection 124 adjacent support element 130 and a third volume define radially inwardly of support element 130. Third volume 136 may be fluidically connected with second volume 134. A first pressure port 140 extends radially through running tool 44 fluidically connecting passage 82 and first volume 132 and a second pressure port 142 extends radially through running tool 44 fluidically connecting third volume 136 and passage 82.

In operation, running tool 44 is connected to liner hanger 48 through liner hanger support system 94 and run into wellbore 34. During run in, pressure applied to second volume 134 via third volume 136 maintains dog support 106 in the deployed configuration. Second pressure port 142 and third volume 136 are sized such that minimal pressure is needed to maintain the position of dog support 106. Once in a desired position as detected by, for example control system 23, forcing cone 68 may be shifted axially downwardly into liner hanger 48 such as shown in FIG. 3. Forcing cone 68 caused angled region 66 to transition downwardly such that anchor slip 54 and packer seal 56 are forced into engagement with annular wall 38.

As forcing cone 68 is being deployed, cone carrier 90 is guided into contact with pusher 121. Movement of cone carrier 90 causes dog support 106 to shift axially allowing dog 108 to move radially inwardly disengaging from liner hanger 48. At this point, running tool 44 may be withdrawn from wellbore 34 or deployed for another purpose.

Figure 5:
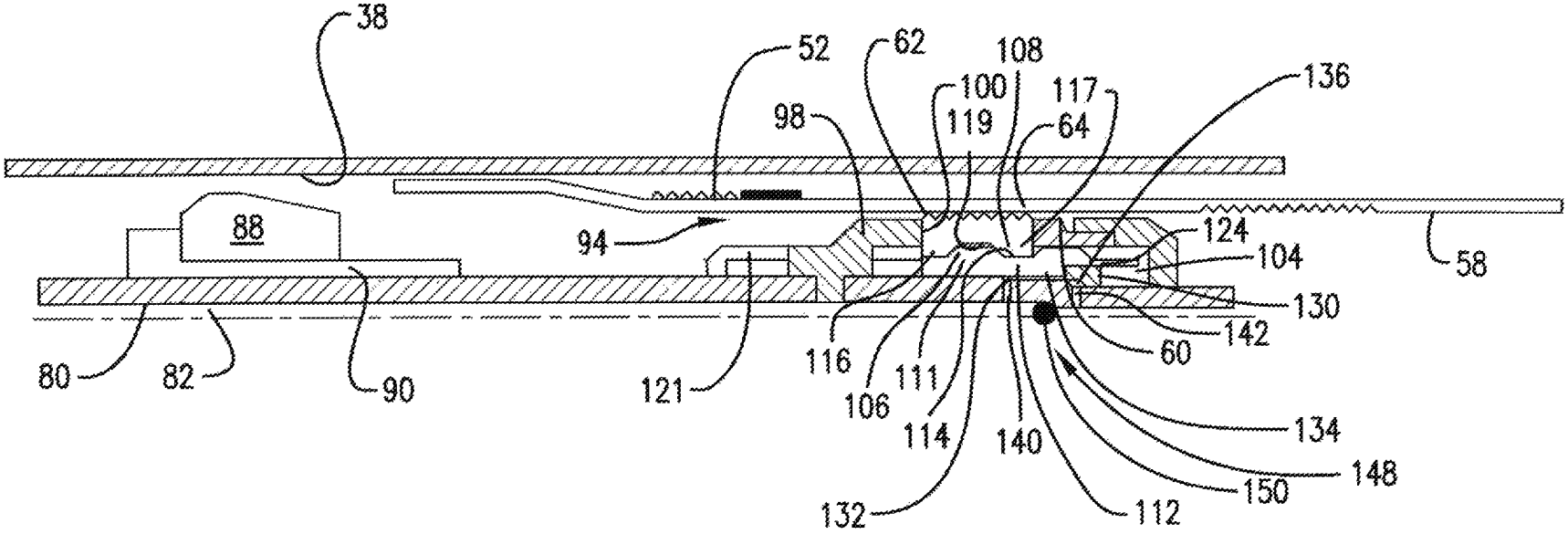
FIG. 5 depicts a running tool tripping a liner hanger into a wellbore, in accordance with another aspect of an exemplary embodiment.
Figure 6:
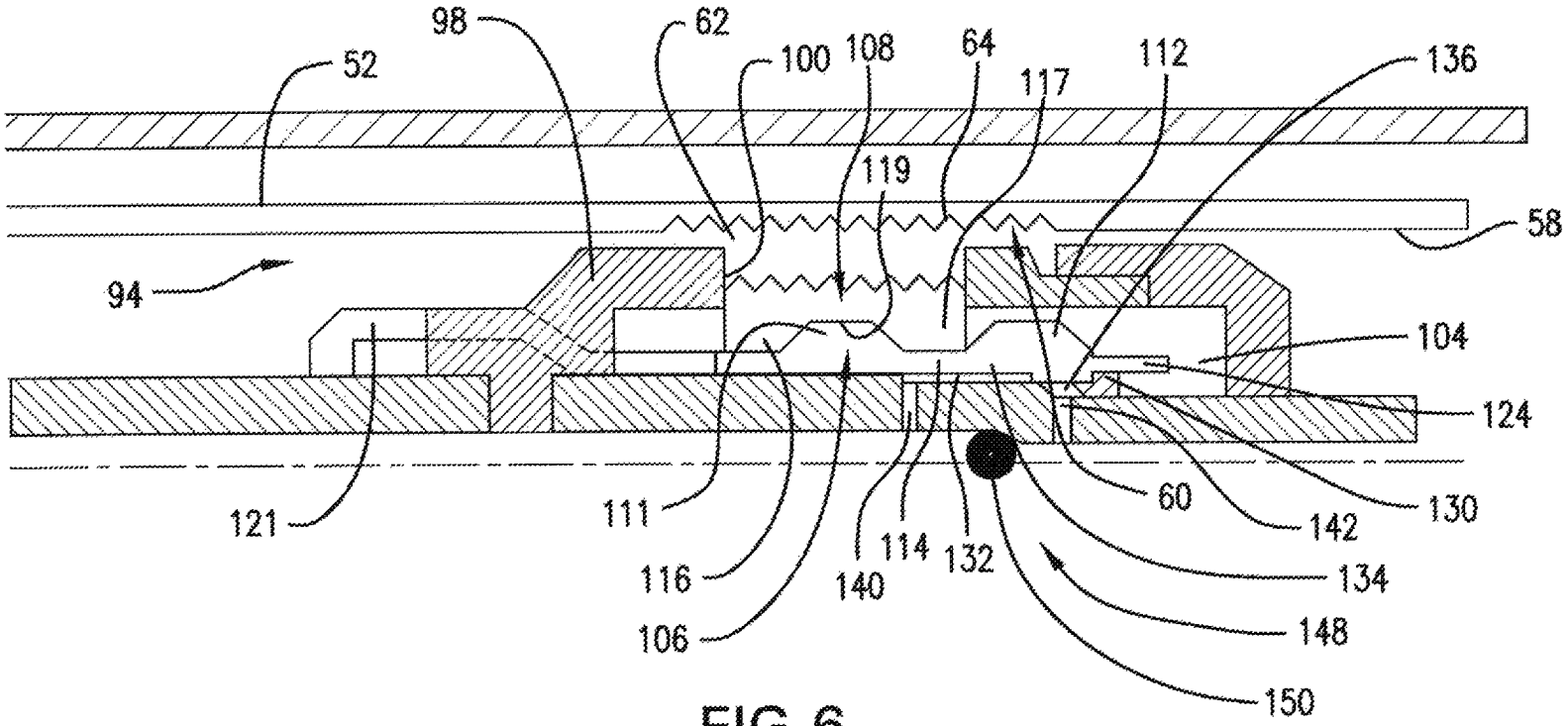
FIG. 6 depicts a detail view of a portion of the running tool and the liner hanger of FIG. 5, in accordance with an aspect of an exemplary embodiment.
Figure 7:
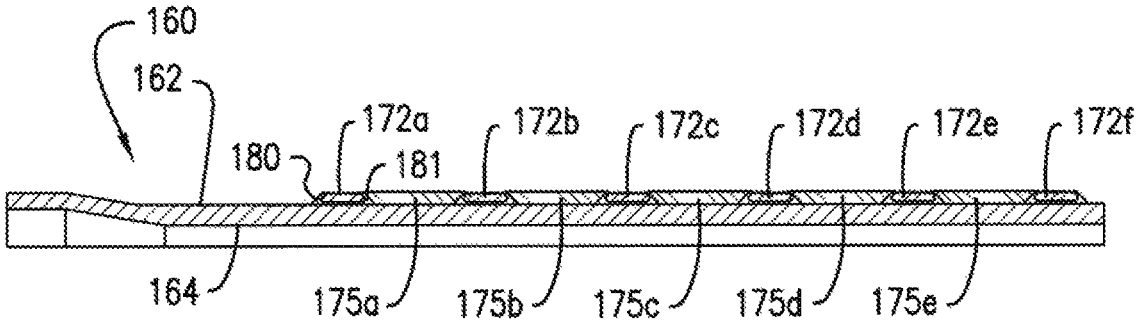
FIG. 7 depicts a partial cross-sectional view of a liner hanger including anchor seals, in accordance with another aspect of an exemplary embodiment.
Figure 8:
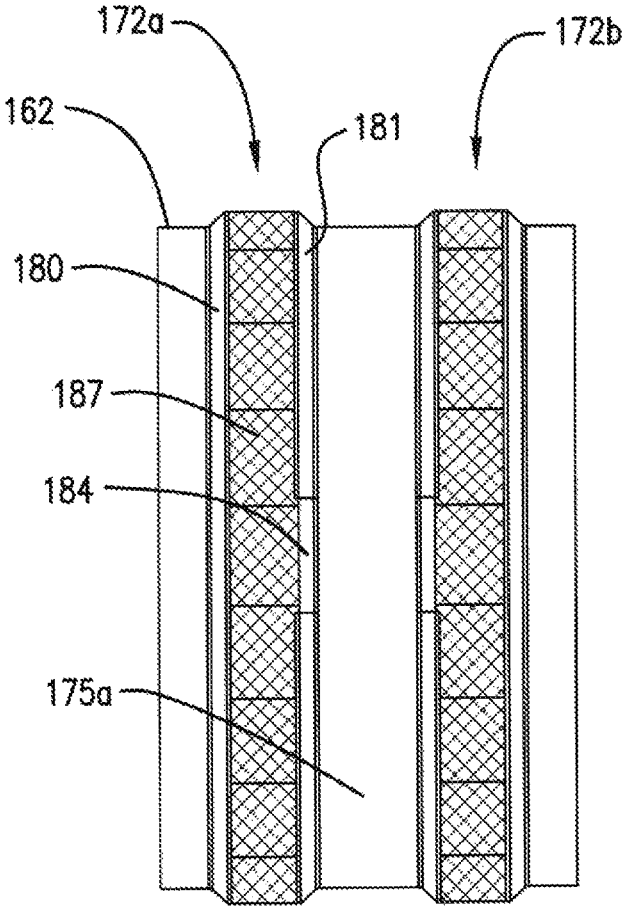
FIG. 8 depicts a plan view of a portion of an outer surface of the liner hanger of FIG. 7.
Figure 9:
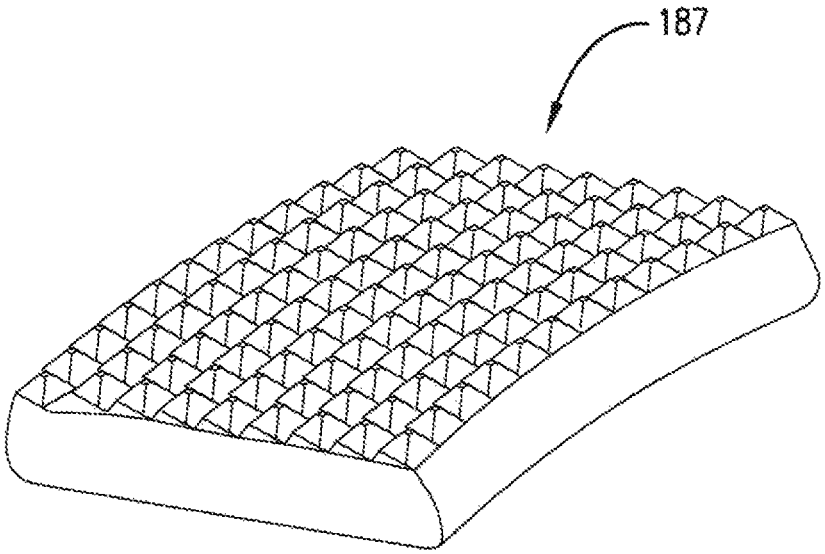
FIG. 9 depicts a view of an anchor seal of the liner hanger of FIG. 7, in accordance with an aspect of an exemplary embodiment.
Figure 10:
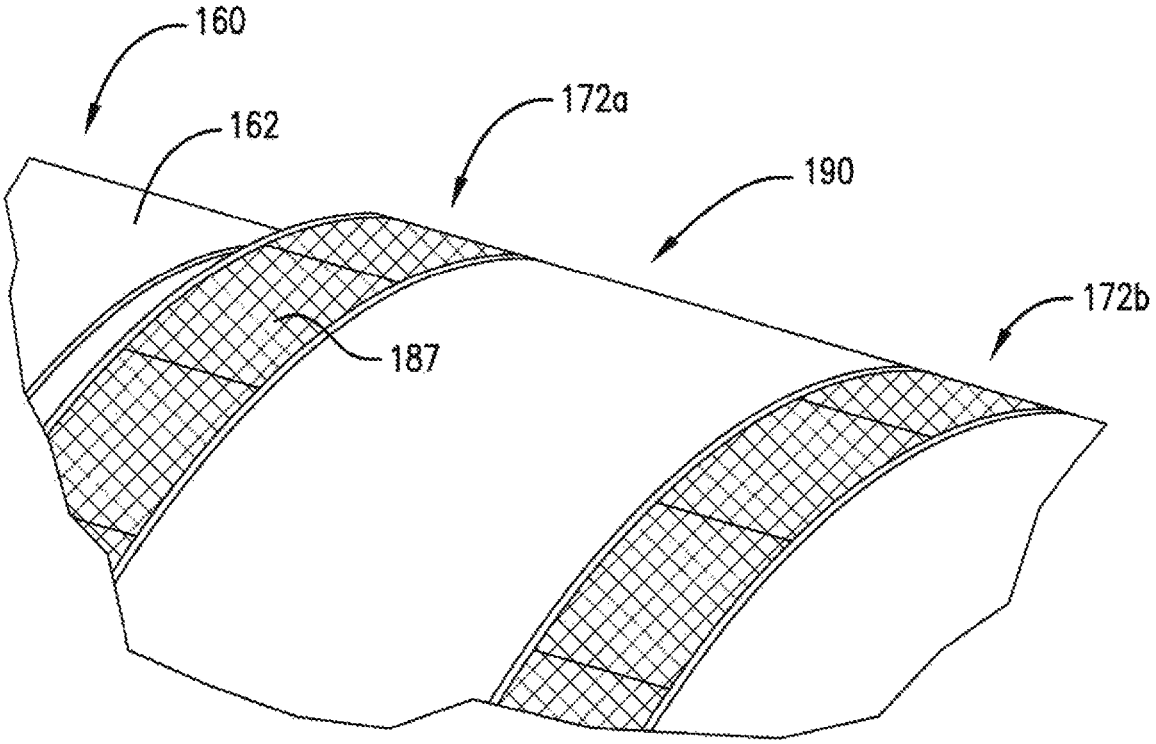
FIG. 10 depicts an outer surface of a liner hanger, in accordance with another aspect of an exemplary embodiment.

In accordance with an aspect of an exemplary embodiment, inner surface portion 80 of running tool 44 includes a flow restriction support 144 that may take the form of a ball seat. In the event that cone carrier 90 does not engage pusher 121 such as shown in FIGS. 5 and 6, a flow restriction member 148 such as a drop ball 150 may be forced against ball seat 146. Pressure is applied to dog support 106 through first pressure port 140. The pressure causes dog support 106 to shift allowing dog 108 to disengage (FIG. 5).

Reference will now follow to FIGS. 7-10 in describing a liner hanger 160 in accordance with another aspect of an exemplary embodiment. Liner hanger 160 include an outer surface 162 and an inner surface 164 that supports a running tool engagement element (not shown). Liner hanger 160 may include a plurality of anchor slips 172*a*-172*f* arranged on outer surface 162 and spaced from one another by a plurality of gaps 175*a*-175*e*.

Each anchor element 172*a*-172*f* is arranged in a recess 178 flanked by a first annular rib 180 and a second annular rib 181. First and second annular ribs form a dove tail (not separately labeled). Second annular rib 184 is shown to include a void region 184 (FIG. 8) that allows a plurality of anchor slip plates, one of which is shown at 187 in FIG. 9 to be installed into recess 178 about outer surface 162. In an embodiment, liner hanger 160 may include a plurality of packer seals arranged in each of the plurality of gaps 175*a*-175*e* such as indicated at 190 in FIG. 10.

At this point, it should be understood that the exemplary embodiments describe a liner hanger that may be deployed downhole and expanded into engagement with an annular wall of a wellbore. The liner hanger may be expanded into contact with a casing tubular, or a cemented surface of the wellbore. In this manner, the wellbore can be extended without the need for multiple liner hanger installation and cementing operations.

Set forth below are some embodiments of the foregoing disclosure:

Embodiment 1

A system for subterranean deployment in a wellbore comprising: an expandable tubular including an outer surface supporting at least one anchor slip and an inner surface including a running tool engagement element; and a running tool for deploying the expandable tubular into the wellbore, the running tool including an inner surface portion defining a passage and an outer surface portion supporting a forcing cone for expanding at least a portion of the expandable tubular, and a tubular support system selectively engaging with the running tool engagement element.

Embodiment 2

The system according to any previous embodiment, wherein the running tool engagement element comprises a plurality of teeth formed in the inner surface of the expandable tubular.

Embodiment 3

The system according to any previous embodiment, wherein the plurality of teeth is defined by a plurality of threads.

Embodiment 4

The system according to any previous embodiment, wherein the tubular support system includes a dog selectively radially inwardly shiftably supported upon the outer surface portion, the dog including a plurality of features that are selectively engageable with the plurality of teeth.

Embodiment 5

The system according to any previous embodiment, wherein the tubular support system includes a dog body that guides the dog between a deployed position and a non-deployed position.

Embodiment 6

The system according to any previous embodiment, wherein the tubular support system includes a dog support that is slideably mounted to the outer surface portion of the running tool.

Embodiment 7

The system according to any previous embodiment, wherein the running tool includes a pressure port fluidically connecting the passage and the dog support.

Embodiment 8

The system according to any previous embodiment, wherein the inner surface portion defines a flow restriction support arranged axially outwardly of the pressure port.

Embodiment 9

The system according to any previous embodiment, further comprising: an actuator operatively associated with the dog support.

Embodiment 10

The system according to any previous embodiment, wherein the forcing cone is mounted to a cone carrier slideably mounted to the outer surface portion of the running tool, the cone carrier selectively engaging the dog support to radially inwardly shift the dog away from the expandable tubular.

Embodiment 11

The system according to any previous embodiment, wherein the at least one anchor slip includes is formed by a plurality of anchor slip plates detachable mounted to the outer surface of the expandable tubular.

Embodiment 12

The system according to any previous embodiment, wherein the outer surface of the expandable tubular includes a first annular rib spaced from a second annular rib, the plurality of anchor slip plates being secured to the expandable tubular between the first and second annular ribs.

Embodiment 13

The system according to any previous embodiment, wherein the at least one anchor slip includes a first anchor slip extending annularly about the outer surface of the expandable tubular and a second anchor slip extending annularly about the outer surface of the expandable tubular spaced from the first anchor slip by a gap.

Embodiment 14

The system according to any previous embodiment, further comprising: a packer seal arranged in the gap.

Embodiment 15

A method of setting a expandable tubular comprising: connecting a running tool engagement element arranged on an expandable tubular and a tubular support system provide on a running tool; running the expandable tubular into a wellbore; expanding the expandable tubular radially outwardly by driving a forcing cone along the running tool; engaging an anchor slip supported on an outer surface of the expandable tubular with a casing tubular; and disengaging the tubular support system from the running tool engagement element.

Embodiment 16

The method of any previous embodiment, wherein disengaging the running tool includes radially inwardly shifting a dog of the tubular support system.

Embodiment 17

The method of any previous embodiment, wherein radially inwardly shifting the dog includes axially sliding a dog support.

Embodiment 18

The method of any previous embodiment, wherein axially sliding the dog support includes engaging an actuator with a cone carrier when expanding the expandable tubular.

Embodiment 19

The method of any previous embodiment, wherein axially sliding the dog support includes: dropping a flow restriction member into the running tool; and delivering pressure radially outwardly through the running tool into a chamber defined by the dog support.

Embodiment 20

The method of any previous embodiment, wherein expanding the expandable tubular includes forcing an anchor slip against an annular wall of the wellbore.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A system for subterranean deployment in a wellbore comprising:

an expandable tubular including an outer surface supporting at least one anchor slip and an inner surface including a running tool engagement element, the at least one anchor slip being formed by a plurality of anchor slip plates detachably mounted to the outer surface of the expandable tubular; and a running tool for deploying the expandable tubular into the wellbore, the running tool including an inner surface portion defining a passage and an outer surface portion supporting a forcing cone for expanding at least a portion of the expandable tubular, and a tubular support system selectively engaging with the running tool engagement.

2. The system according to claim 1, wherein the running tool engagement element comprises a plurality of teeth formed in the inner surface of the expandable tubular.

3. The system according to claim 2, wherein the plurality of teeth are defined by a plurality of threads.

4. The system according to claim 2, wherein the tubular support system includes a dog selectively radially inwardly shiftably supported upon the outer surface portion, the dog including a plurality of features that are selectively engageable with the plurality of teeth.

5. The system according to claim 4, wherein the tubular support system includes a dog body that guides the dog between a deployed position and a non-deployed position.

6. The system according to claim 4, wherein the tubular support system includes a dog support that is slideably mounted to the outer surface portion of the running tool.

7. The system according to claim 6, wherein the running tool includes a pressure port fluidically connecting the passage and the dog support.

8. The system according to claim 7, wherein the inner surface portion defines a flow restriction support arranged axially outwardly of the pressure port.

9. The system according to claim 6, further comprising: an actuator operatively associated with the dog support.

10. The system according to claim 9, wherein the forcing cone is mounted to a cone carrier slideably mounted to the outer surface portion of the running tool, the cone carrier selectively engaging the dog support to radially inwardly shift the dog away from the expandable tubular.

11. The system according to claim 1, wherein the outer surface of the expandable tubular includes a first annular rib spaced from a second annular rib, the plurality of anchor slip plates being secured to the expandable tubular between the first and second annular ribs.

12. The system according to claim 1, wherein the at least one anchor slip includes a first anchor slip extending annularly about the outer surface of the expandable tubular and a second anchor slip extending annularly about the outer surface of the expandable tubular spaced from the first anchor slip by a gap.

13. The system according to claim 12, further comprising: a packer seal arranged in the gap.

14. A method of setting an expandable tubular comprising:

connecting a running tool engagement element arranged on an expandable tubular and a tubular support system provide on a running tool;

running the expandable tubular into a wellbore;

expanding the expandable tubular radially outwardly by driving a forcing cone along the running tool;

engaging an anchor slip formed by a plurality of anchor slip plates detachably mounted to on an outer surface of the expandable tubular with a casing tubular; and disengaging the tubular support system from the running tool engagement element.

15. The method of claim 14, wherein disengaging the running tool includes radially inwardly shifting a dog of the tubular support system.

16. The method of claim 15, wherein radially inwardly shifting the dog includes axially sliding a dog support.

17. The method of claim 16, wherein axially sliding the dog support includes engaging an actuator with a cone carrier when expanding the expandable tubular.

18. The method of claim 16, wherein axially sliding the dog support includes:

dropping a flow restriction member into the running tool; and delivering pressure radially outwardly through the running tool into a chamber defined by the dog support.

19. The method of claim 14, wherein expanding the expandable tubular includes forcing an anchor slip against an annular wall of the wellbore.

* * * * *